US007527257B2

(12) United States Patent
Trilk et al.

(10) Patent No.: US 7,527,257 B2
(45) Date of Patent: May 5, 2009

(54) METHOD AND DEVICE FOR LIFTING INDIVIDUAL FLAT OBJECTS, PARTICULARLY PRINTING PLATES TO BE EXPOSED

(75) Inventors: Axel Trilk, Kiel (DE); Berhard Karl Wolff, Krokau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 612 days.

(21) Appl. No.: 10/865,565

(22) Filed: Jun. 9, 2004

(65) Prior Publication Data

US 2005/0002774 A1 Jan. 6, 2005

(30) Foreign Application Priority Data

Jul. 3, 2003 (DE) ..... 103 30 010

(51) Int. Cl.
*B65H 3/08* (2006.01)

(52) U.S. Cl. ..... 271/104; 271/90; 271/105

(58) Field of Classification Search ..... 271/90, 271/105, 106, 104
See application file for complete search history.

(56) References Cited

U.S. PATENT DOCUMENTS

| | | | | |
|---|---|---|---|---|
| 853,910 | A | 5/1907 | Tyden | |
| 3,826,485 | A * | 7/1974 | Shindo | 271/106 |
| 4,824,308 | A * | 4/1989 | Carboniero et al. | 414/797 |
| 5,048,811 | A * | 9/1991 | Hochbein | 271/5 |
| 5,106,260 | A * | 4/1992 | Obrecht | 414/796.6 |
| 5,257,776 | A * | 11/1993 | Suya et al. | 271/11 |
| 5,785,309 | A * | 7/1998 | Halup et al. | 271/11 |
| 5,899,341 | A * | 5/1999 | Irita | 209/571 |
| 6,422,801 | B1 * | 7/2002 | Solomon | 414/416.07 |
| 6,431,623 | B1 * | 8/2002 | Roeters et al. | 294/64.1 |
| 7,044,056 | B2 * | 5/2006 | Miyoshi | 101/477 |
| 2002/0101027 | A1 | 8/2002 | Koster et al. | |

FOREIGN PATENT DOCUMENTS

| | | | |
|---|---|---|---|
| DE | 2 256 793 | | 2/1974 |
| DE | 40 02 324 | A1 | 8/1991 |
| DE | 101 04 078 | A1 | 8/2002 |
| EP | 0 486 719 | A1 | 5/1992 |
| GB | 2234488 | A * | 2/1991 |
| JP | 54-115871 | * | 9/1979 |
| JP | 61-209734 | * | 9/1986 |
| JP | 3-200639 | * | 9/1991 |

* cited by examiner

*Primary Examiner*—Patrick H Mackey
*Assistant Examiner*—Thomas A Morrison
(74) *Attorney, Agent, or Firm*—Laurence A. Greenberg; Werner H. Stemer; Ralph E. Locher

(57) ABSTRACT

A method for lifting individual flat objects from a stack of objects includes providing at least two suction elements spaced apart from one another for lifting a respective object, alternately lifting the respective objects with the suction elements, and either forcing the respective object in at least one deforming direction or deforming the respective object in at least one region thereof during the lifting of the respective object. The method further includes providing, between the at least two suction elements, at least one plunger for deforming the respective object. The invention further relates to a device for performing the method.

4 Claims, 1 Drawing Sheet

METHOD AND DEVICE FOR LIFTING INDIVIDUAL FLAT OBJECTS, PARTICULARLY PRINTING PLATES TO BE EXPOSED

BACKGROUND OF THE INVENTION

Field of the Invention

The invention relates to a method for lifting individual flat objects, particularly printing plates which are to be exposed, from a stack of objects, in particular from a stack wherein, respectively, two different objects alternate, preferably respectively, a printing plate and an intermediate layer separating two consecutive printing plates from one another are alternately disposed, preferably for automatically loading a printing plate exposer, the method including providing at least two mutually spaced-apart suction elements for lifting a respective object and, while lifting the respective object, deforming the respective object, particularly with a bulge or bump, at least in one region thereof or subjecting the respective object to a force in at least one deformation direction.

Furthermore, the invention relates to a device for lifting individual flat objects, particularly printing plates which are to be exposed, from a stack of objects, in particular from a stack wherein, respectively, two different objects alternate, preferably, respectively, a printing plate and an intermediate layer separating two consecutive printing plates from one another are alternately disposed, preferably for automatically loading a printing plate exposer, the device including at least two mutually spaced-apart elements for lifting a respective object, and suitable equipment serving, during the lifting of the respective object, for deforming the respective object, particularly with a bulge or bump, at least in one region, or for applying force thereto in at least one deformation direction, preferably for performing the aforementioned method.

A method and a device of the foregoing general type are disclosed in the German Published Prosecuted Patent Application DE-A-101 04 078, corresponding to U.S. Patent Application Publication U.S. 0200101027A1.

During automatic separation or singling of flat objects, in particular printing plates from a stack, for example in the region of a cassette loader for a printing plate exposer, wherein, during the separation process, the flat objects are respectively lifted individually by suction elements, a problem may occur wherein two of the objects may adhere to one another and be lifted together, which may cause a disruption in a subsequent device because a single object is not then present. In the case of printing plates which are normally stacked with separating intermediate layers, for example paper sheets, so that, in the stack, a respective printing plate is followed by an intermediate layer, and an intermediate layer is followed by a respective printing plate, it is possible that another printing plate may stick under an intermediate layer, or an intermediate layer may stick under a respective printing plate, or a second printing plate may stick under a first printing plate because an intermediate layer is missing.

In order to avoid such errors, it is usually insufficient to lift the uppermost flat object from the stack, but rather, it is also necessary to check the underside as a precaution and "peel off" in some suitable manner any second object which might be adhering thereto. In addition, it should again be stressed that the flat objects under consideration do not necessarily have to be of the same type, but rather, for example, the first object could be an intermediate layer and the second object a printing plate.

In the aforecited German or corresponding U.S. published reference, it has been proposed to cause the printing plate which is to be lifted to bulge somewhat by an offset arrangement of the suction elements, wherein some suction elements protrude somewhat less of a distance in the direction of the printing plate than others, and to blow air into the intermediate space produced as a result below the printing plate, in order in this manner to force the printing plate to detach itself from the stack.

However, this procedure is complicated and not very suitable for the case wherein an intermediate layer is to be lifted up and a printing plate remains adhering to the underside thereof. It had been assumed that it was improbable for a printing plate to adhere to the underside of an intermediate layer because the former, due to the relatively great inherent weight thereof, will tend to fall off again of its own accord and fall back onto the stack. However, it has been found that, in fact, printing plates do indeed adhere to the underside of intermediate layers. Firstly, because the adhesion forces can be more considerable than the weight acting upon the printing plate, but secondly also because the edge regions of the intermediate layer and the printing plates often do not terminate exactly flush with one another but, rather, the edges of the printing plate which lies under the intermediate layer protrude over the latter, so that a free edge region of the printing plate lies exposed. Because, the suction elements, however, are arranged as far towards the edges as possible, in order that the activity thereof does not as much as possible damage or impair the central region of the printing plate which is subsequently to have images set thereon, it may occur that the suction elements themselves grip and lift the intermediate layer and the printing plate situated thereunder simultaneously. This then additionally compensates for the inherent weight of the printing plate and it is then also scarcely effectively possible to peel off the printing plate merely by the use of air.

SUMMARY OF THE INVENTION

It is accordingly an object of the invention to provide a method and a device of the general type described in the introduction hereto wherein by acting upon the upper side of the object to be lifted, such action by itself serves to render it difficult for another object to adhere to the underside of the object to be lifted.

With the foregoing and other objects in view, there is provided in accordance with a first aspect of the invention, a method for lifting individual flat objects from a stack of objects, which comprises providing at least two suction elements spaced apart from one another for lifting a respective object; alternately lifting the respective objects with the suction elements; and at least one of forcing the respective object in at least one deforming direction and deforming the respective object in at least one region thereof during the lifting of the respective object; and which further comprises providing, between the at least two suction elements, at least one plunger for deforming the respective object.

In accordance with a second aspect of the invention, there is provided a method for lifting individual flat objects including printing plates to be exposed, from a stack of objects made up of different alternating objects consisting of printing plates and a respective intermediate layer separating respective consecutive printing plates from one another, for automatically loading a printing plate exposer, the method comprising providing at least two mutually spaced-apart suction elements for lifting a respective object; and, while lifting the respective object, deforming the respective object, with a bulge or bump, at least in one region thereof; and further comprising providing, between the at least two suction elements, at least one plunger for deforming the respective object.

In accordance with a third aspect of the invention, there is provided a method for lifting individual flat objects including printing plates to be exposed, from a stack of objects made up of different alternating objects consisting of printing plates and a respective intermediate layer separating respective consecutive printing plates from one another, for automatically loading a printing plate exposer, the method comprising providing at least two mutually spaced-apart suction elements for lifting a respective object; and, while lifting the respective object, forcing the respective object in at least one deformation direction; and further comprising providing, between the at least two suction elements, at least one plunger for forcing the respective object in the at least one deformation direction.

In accordance with another mode, the method further comprises, prior to lifting the respective object, displacing the respective object against a stop in at least an approximately horizontal plane.

In accordance with a further mode, the method of the invention includes, with the plunger, displacing the respective object against the stop.

In accordance with a fourth aspect of the invention, there is provided a device for lifting individual flat objects from a stack of objects, comprising at least two mutually spaced-apart suction elements for lifting a respective object from the stack; and at least on e plunger arranged between the at least two suction elements for either deforming the object to be lifted at least in one region during lifting, and applying force to the object at least in one deformation direction.

In accordance with a fifth aspect of the invention, there is provided a device for lifting individual flat objects, including printing plates to be exposed, from a stack of objects wherein, respectively, two different objects alternate, the different objects being a printing plate and an intermediate layer separating two consecutive printing plates from one another alternately, for automatically loading a printing plate exposer, the device comprising at least two mutually spaced-apart suction elements for lifting the respective objects; and at least one plunger arranged between the at least two suction elements, for either deforming with a bulge the respective object to be lifted, in at least one region thereof during lifting, and applying force in at least one deformation direction to the respective object to be lifted.

In accordance with an added feature of the invention, the device includes a stop; and a sliding member for displacing, in an at least approximately horizontal plane against the stop, the respective object to be lifted, prior to lifting of the respective object.

In accordance with an additional feature of the invention, the plunger is configured as a sliding member.

In accordance with yet another feature of the invention, the plunger formed as a sliding member is disposed and configured so as to precede the suction elements in a direction towards the respective object to be lifted and in a direction towards the stop.

In accordance with yet a further feature, the sliding member is spring-biased in the direction towards the respective object to be lifted.

In accordance with an alternative feature of the invention, the sliding member is resiliently loadable in the direction towards the respective object to be lifted.

In accordance with a concomitant feature of the invention, the sliding member has an angle of attack in the direction of the stop.

According to the invention, therefore, the object which is to be lifted is not deformed by the arrangement of the suction elements as in the prior art cited in the introduction hereto, but by at least one plunger acting between suction elements in a direction towards the object to be lifted.

Preferably, a plurality of suction elements and a plurality of plungers alternate with one another in a row, respectively, within respective gaps therebetween, so that the object to be lifted is deformed in a corrugated or wave-shaped manner.

This has a favorable effect, in particular, in the case wherein an intermediate layer is to be lifted, and a printing plate remains adhering thereto. The relatively thin intermediate layer is namely deformed in accordance with the invention, while the relatively stiffer printing plate is not, or only to a lesser extent, deformed, so that the adhesive forces are broken, and the printing plate actually yet falls away due to the inherent weight thereof. In the reverse case, when an intermediate layer tends to adhere to a printing plate, either the application of force to the printing plate may be sufficient to disrupt the adhesion of the intermediate layer, or active peeling off, for example by the application of additionally provided air, may be effective for this case. If a printing plate tends to adhere to another printing plate, the disruption caused by the application of the deformation force should be sufficient to separate the plates because, although the upper printing plate might not be deformed to a visible extent due to the inherent stability or rigidity thereof, the upper printing plate is nevertheless exposed to greater stresses than the lower one in every case, so that even these relatively small disruptive differences are sufficient to terminate the adhesion or, in fact, cohesion of the two printing plates.

A further refinement of the method according to the invention provides for the object, which is to be lifted, to be displaced against a stop in or approximately in a horizontal plane prior to being lifted.

As a result, it is advantageously initially ensured that the object to be lifted completely covers the object situated therebelow at the edges, in order to ensure that the object to be lifted and only this object is completely gripped by the suction elements. It is also possible that the adhesion of the lower object is already interrupted as a result.

One particularly advantageous refinement provides for the object to be lifted to be displaced by the plunger itself.

The device according to the invention thus calls for at least one plunger be arranged between at least two suction elements to serve for suitably deforming a respective object. The aspects and advantages resulting therefrom have already been described in conjunction with the method according to the invention.

In particular, a feature of the device according to the invention particularly advantageously provides for the plunger, as a sliding member, to be arranged and configured so as to precede the suction elements in the direction of the object to be lifted and in the direction of the stop.

It is moreover possible for the sliding member to be capable of being loaded resiliently or to be spring-loaded in the direction towards the object to be lifted, for example by a spring or by the inherent elasticity of the material thereof. Additionally or as an alternative, provision may be made for the sliding member to have an angle of attack disposed in the direction towards the stop.

Although the invention is illustrated and described herein as embodied in a method and device for lifting individual flat objects, particularly printing plates to be exposed, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1A:
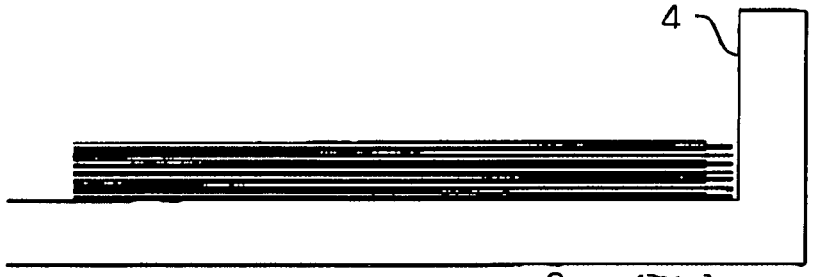
FIGS. 1A to 1E are diagrammatic side elevational views of a device according to the invention in chronologically successive phases of operation thereof during lifting of a stack of flat objects, thereby serving simultaneously to illustrate an exemplary mode of the method according to the invention.

Referring now to the drawings and, first, particularly, to FIG. 1A thereof, there is shown therein, in a side elevational view, a stack of flat objects formed of relatively longer printing plates and shorter intermediate layers, respectively, alternating with one another in the stack. The stack is situated in a type of pocket or cassette having at least a floor or base and an upright end wall simultaneously serving as an edge-side stop 4 for the flat objects.

Figure 1B:
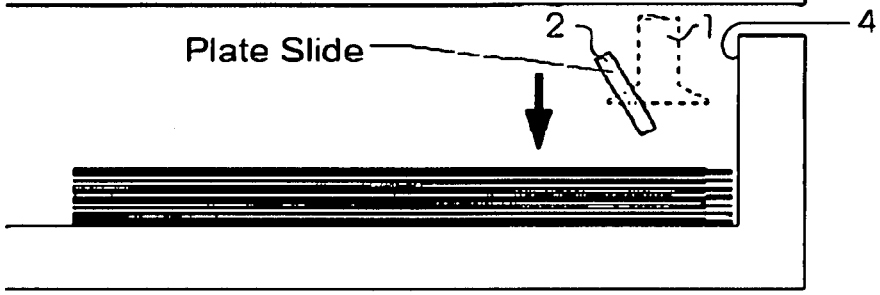

In FIG. 1B, a suction element 1 and a sliding and plunger element 2 of the device according to the invention are lowered in the direction of the stack in order to lift off the uppermost intermediate layer. As is believed to be apparent from FIG. 1F, a plurality of suction elements 1 are arranged and configured in a row as a suction strip or bar, and a respective sliding and plunger element 2 is situated in the gap between two mutually adjacent suction elements 1. As can be seen in the side elevational view of FIGS. 1B and 1C, the sliding and plunger element 2 is, for example, flexible in a manner similar to that of a short windshield wiper blade and is oriented and configured at an angle of attack with respect to the stack.

In FIG. 1B, the sliding and plunger element 2, hereinafter referred to as "slide" in short, precedes the suction element 1 downwardly and makes contact first with the intermediate layer to be lifted.

Figure 1C:
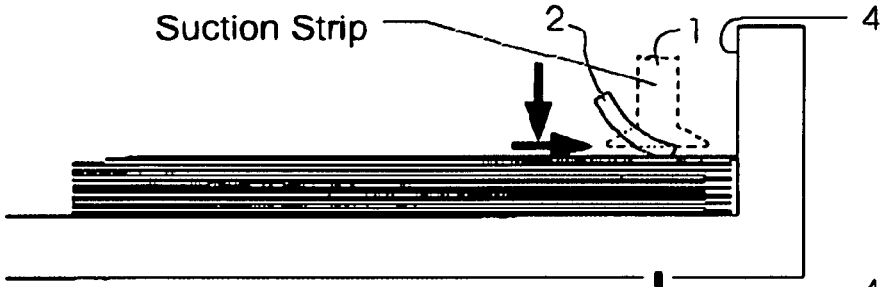
Figure 1D:
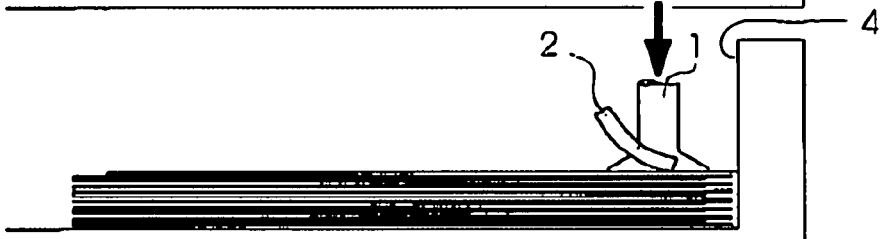
Figure 1E:
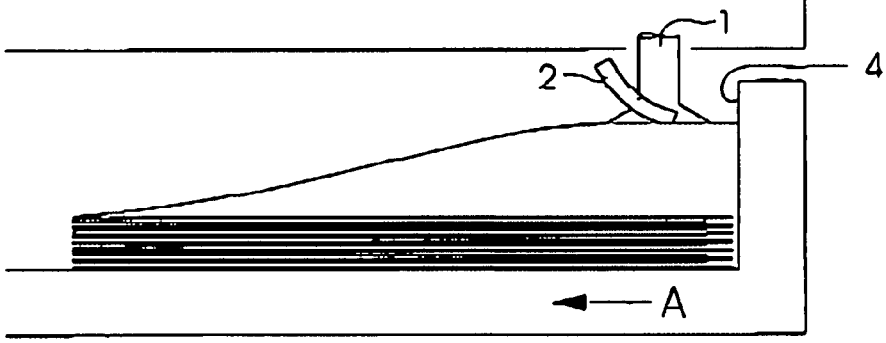
Figure 1F:
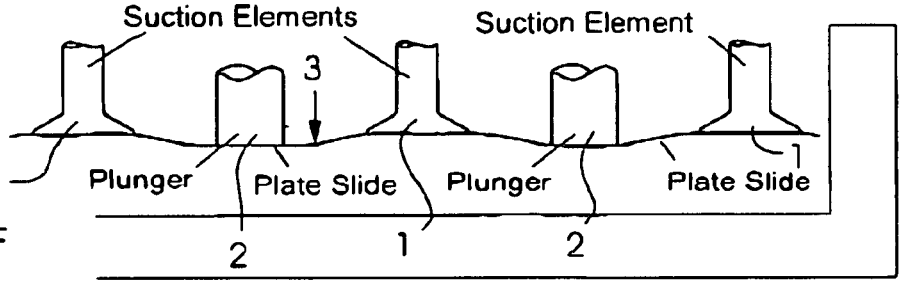
FIG. 1F is a sectional view of FIG. 1E, providing an end view of the device according to the invention as viewed in the direction of the arrow A.

In FIG. 1C, the slide 2 initially slides the intermediate layer to be lifted against the end wall 4 of the pocket, so that the intermediate layer covers the printing plate situated thereunder in a flush manner at this edge side. It is only thereafter that the suction element 1 in FIG. 1D also makes contact with the intermediate layer in order to lift the latter. Lifting is finally shown in FIG. 1E, the lifted intermediate layer additionally remaining subjected to pressure applied by the slide 2 or slides. As shown in FIG. 1F, this results in a corrugated or wave-shaped deformation 3 of the lifted intermediate layer, which effectively prevents adhesion thereto of the printing plate situated therebeneath in the stack.

This application claims the priority, under 35 U.S.C. § 119, of German patent application No. 103 30 010.4, filed Jul. 3, 2003; the entire disclosure of this application is herewith incorporated by reference.

We claim:

1. A method for lifting individual flat objects from a stack of objects, which comprises:

providing at least two suction elements spaced apart from one another for lifting a respective object;

consecutively lifting the respective objects with the suction elements; and at least one of forcing the respective object in at least one deforming direction and deforming the respective object in at least one region thereof during the lifting of the respective object;

providing, between the at least two suction elements, at least one plunger for deforming the respective object; and prior to contacting the respective object with the suction elements, displacing the respective object in a substantially horizontal plane against a stop with the at least one plunger.

2. A method for lifting individual flat objects including printing plates to be exposed, from a stack of objects made up of different alternating objects consisting of printing plates and a respective intermediate layer separating respective consecutive printing plates from one another, for automatically loading a printing plate exposer, the method comprising:

providing at least two mutually spaced-apart suction elements for lifting a respective object;

while lifting the respective object, deforming the respective object, with a bulge or bump, at least in one region thereof;

providing, between the at least two suction elements, at least one plunger for deforming the respective object; and prior to contacting the respective object with the suction elements, displacing the respective object in a substantially horizontal plane against a stop with the at least one plunger.

3. A method for lifting individual flat objects including printing plates to be exposed, from a stack of objects made up of different alternating objects consisting of printing plates and a respective intermediate layer separating respective consecutive printing plates from one another, for automatically loading a printing plate exposer, the method comprising:

providing at least two mutually spaced-apart suction elements for lifting a respective object; and, while lifting the respective object, forcing the respective object in at least one deformation direction;

providing, between the at least two suction elements, at least one plunger for forcing the respective object in the at least one deformation direction; and prior to contacting the respective object with the suction elements, displacing the respective object in a substantially horizontal plane against a stop with the at least one plunger.

4. The method according to claim 1, further comprising:

bending a longitudinal axis of the plunger during the displacing of the respective object.

* * * * *